US006068146A

United States Patent [19]

Trent et al.

[11] Patent Number: 6,068,146

[45] Date of Patent: May 30, 2000

[54] UNIVERSAL COUPLER CARRIER WEAR PLATE

[75] Inventors: Robert S. Trent, Crown Point, Ind.; R. Michael Manley, Richmond, Tex.; Todd J. De Koning, Tinley Park, Ill.

[73] Assignee: Holland Company, Crete, Ill.

[21] Appl. No.: 09/173,062

[22] Filed: Oct. 14, 1998

Related U.S. Application Data

[60] Provisional application No. 60/062,175, Oct. 16, 1997.

[51] Int. Cl.[7] ..... B61G 7/10

[52] U.S. Cl. ..... 213/61; 213/50

[58] Field of Search ..... 213/75 R, 56, 213/60, 62 R, 66, 69, 61, 50.5, 50

[56] References Cited

U.S. PATENT DOCUMENTS

| | | | |
|---|---|---|---|
| 2,271,907 | 2/1942 | Wilson | 213/60 |
| 3,104,017 | 9/1963 | Kulieke et al. | 213/61 |
| 3,610,436 | 10/1971 | Wisler | 213/61 |
| 4,032,017 | 6/1977 | Larsen | 213/61 |
| 4,055,254 | 10/1977 | Chierici et al. | 213/61 |
| 4,059,192 | 11/1977 | Larsen | 213/61 |
| 4,120,404 | 10/1978 | Chierici et al. | 213/61 |
| 4,133,434 | 1/1979 | Chierici | 213/61 |
| 4,238,039 | 12/1980 | Cooper et al. | 213/61 |
| 4,249,665 | 2/1981 | Kleykamp | 213/61 |
| 4,261,472 | 4/1981 | Moore et al. | 213/61 |
| 4,264,015 | 4/1981 | Mathieu | 213/61 |
| 4,327,839 | 5/1982 | Kleykamp et al. | 213/61 |
| 4,333,576 | 6/1982 | Kaim | 213/61 |
| 4,334,625 | 6/1982 | Kleykamp | 213/61 |
| 4,706,826 | 11/1987 | Elliot et al. | 213/61 |
| 5,174,457 | 12/1992 | Carroll et al. | 213/61 |

OTHER PUBLICATIONS

McConway & Torley Corporation, Product Specification Sheet, Date Unknown, MT–1 Striker Casting Weld Details.

*Primary Examiner*—S. Joseph Morano
*Assistant Examiner*—Lars Olson
*Attorney, Agent, or Firm*—Lee, Mann, Smith, McWilliams, Sweeney & Ohlson

[57] ABSTRACT

A self-lubricating plastic coupler carrier wear plate is formed in a generally T-shape having an outer flange and an inner flange conforming to said T-shape, said web being notched proximate said inner flange for adequate clearance with railcar draft gear.

10 Claims, 2 Drawing Sheets

UNIVERSAL COUPLER CARRIER WEAR PLATE

PRIORITY

This application relates back to Provisional Application by the same inventors, Ser. No. 60\062,175 filed Oct. 16, 1997.

BACKGROUND OF THE INVENTION

This invention is an improved configuration of an ultra-high molecular weight plastic railroad coupler wear plate having improved geometry enhancing both operational characteristics including increased loss prevention and further having geometry enabling the wear plate to fit coupler carriers of both varying depth and of different internal geometry, such as those manufactured by different manufacturers.

DESCRIPTION OF RELATED ART

Coupler carrier wear plates were originally metal inverted channel-like members. The channel configuration with flanges or legs extended downwardly and horizontally in a transverse direction relative to the railcar. As manufacturers of coupler carriers specifically, and various coupler assembly and draft gear components use their own preferred arrangements, there are variations in both width (relative to the transverse dimension of the railcar) and depth (along the longitudinal direction relative to the railcar). Standard carriers are formed in both four inch (4") and five inch (5") depth.

One improved configuration of a coupler carrier wear plate is to form the wear plate in a generally T-shaped configuration, the arms of the T being aligned with the width of the coupler carrier and having a four inch (4") depth, and the leg of the T providing the additional clearance for a five inch (5") deep coupler carrier. It is also well known to form coupler carrier wear plates of self-lubricating, economical yet tough material, such as high molecular weight polyethylene or other materials having improved durability through improved materials, such as cross linked UHMWPE.

However, in service there is an opportunity to improve the durability, particularly of self-lubricating plastic coupler carrier wear plates through enhanced stability and reduced movement under load. Even the slight lateral movement imparted by the movement of the coupler relative to the carrier can impart uneven wear and bowing or warping. Prior art solutions have been to reinforce the plastic material, such as by molding in either reinforcing metal or non-metal fibers, such as glass fibers. The flanges enabled by the configuration of the invention are longer than prior art designs to prevent or minimize wear plate loss when car components wear. Indeed, with the improved configuration, there is greater flexibility in material choice. While selflubricating materials such as UHMWPE have certain advantages, and may even be preferred, other materials may be suitable. The geometry of this design may therefore permit the use of materials using other strength and durability properties advantageously.

SUMMARY OF THE INVENTION

The invention addresses this problem by an improved coupler carrier wear plate geometry rather than reinforcement because it has been discovered that the reduction of lateral movement of the wear plate relative to the coupler carrier can alter the behavior of the coupler carrier wear plate under deforming loads.

Accordingly, additional flanges are provided in the longitudinal (relative to the railcar) direction normal to the transverse flanges. Further, the transverse flanges can be formed in a slightly deeper configuration so that they provide additional resistance to warping or bowing. In order to adapt the wear plate to universal fit, a series of notches and facets, when compared to the straight channel configuration, enable universal fit. For example, the specific configuration here can be used in any railcar with a standard E-type coupler carrier. This configuration can be fit in older railcars with box-type carriers, as well as other applications generally adapted to a channel-type or T-shaped channel-type wear plate.

DETAILED DESCRIPTION OF THE PREFERRED EMBODIMENT

Figure 2:
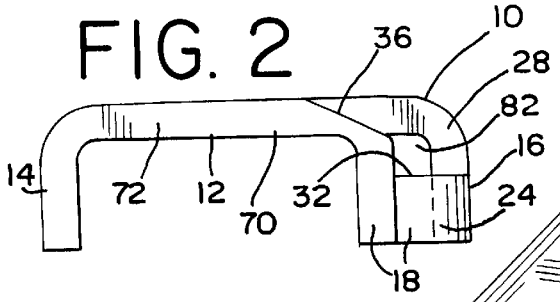
FIG. 2 is a left side elevational view of our improved coupler carrier wear plate.
Figure 1:
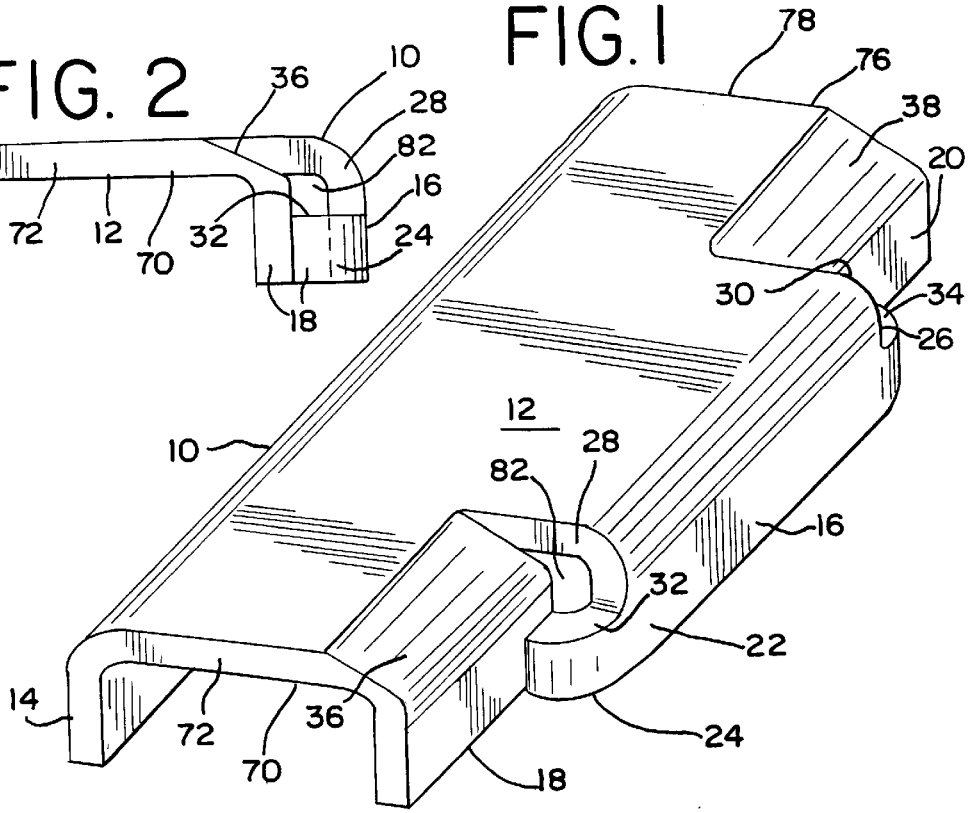
FIG. 1 is a perspective view of our improved coupler carrier wear plate.
Figure 3:
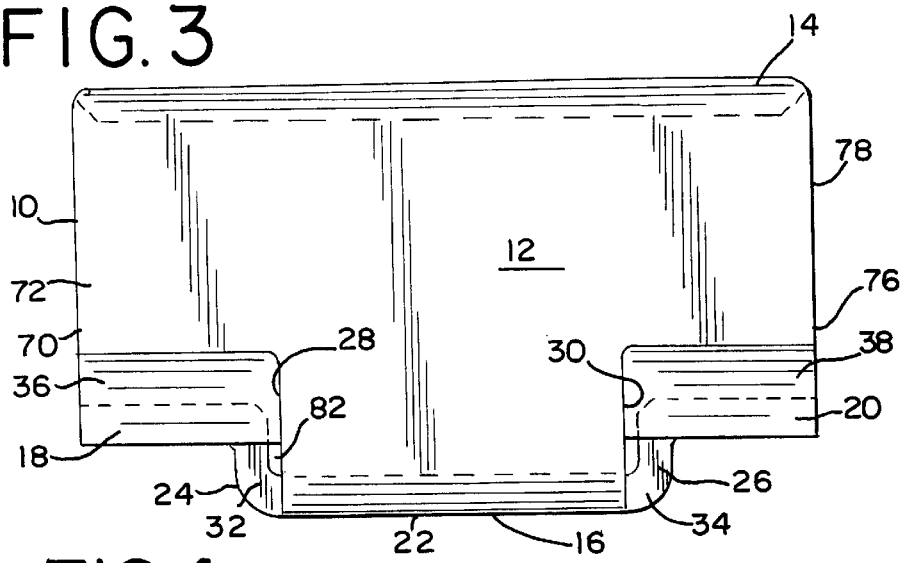
FIG. 3 is top plan view of our improved coupler carrier wear plate.
Figure 4:
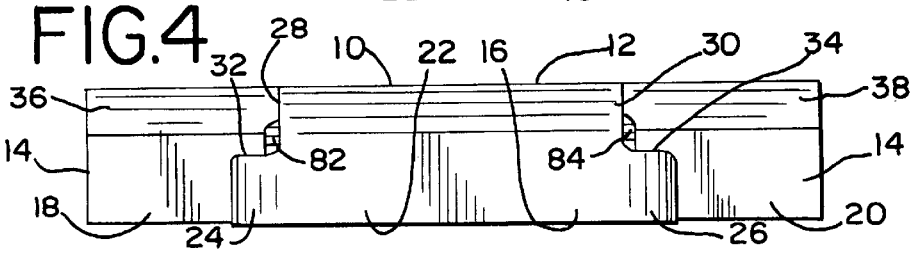
FIG. 4 is a front elevational view of our improved coupler carrier wear plate.

A coupler carrier wear plate 10 is formed preferably of a high molecular weight polymeric material. The coupler carrier wear plate 10 is formed in a generally T-shaped configuration as will be more fully described herein so as to be adapted to fit coupler carriers in the largest possible variety of coupler, striking casting, and related draft gear assemblies. In particular, coupler carriers of various manufacturers have different depths and configurations while couplers themselves, as shown in FIG. 1, are substantially the same. Coupler carrier wear plate 10 is formed with a top coupler supporting web 12 which rests on the coupler carrier in a manner shown and described below. Web 12 depends downwardly into outer flange 14. Opposite flange 14, web 12 merges into inner flange 16. Inner flange 16 is further formed and arranged in a complex shape. Flange 16 comprises a first side portion 18 and a second side portion 20 at the extreme sides of flange 16. Between side portions 18 and 20, there is central portion 22, side portion 18 merging into central portion 22 at curved wall 24, and central portion 22 merging into side portion 20 at curved wall 26. The flanges 14, 16, 18, and 20 are longer than prior art designs to prevent or minimize wear plate loss when car components wear.

The side wall 16 top web 12 intersection at curved wall 24 is cut away as is the intersection at wall 26. These cut aways form first vertical notch surface 28, and second vertical notch surface 30. First horizontal notch portion 32, and second horizontal notch portion 34, portions of web 12 adjacent respective side portions 18, 20 are formed to have beveled notch surface 36 and second bevel notch surface 38 respectively. The combination of bevel notch surfaces 36, 38, vertical notch surfaces 28, 30, and horizontal notch surfaces 32, 34 define a first opening 82 and second opening 84.

The primary purpose of the various notch surfaces 28, 30, 32, 34, 36, and 38 is to provide sufficient clearance for the maximum number of webs, reinforcements, yokes, couplers, and the like which are in use in the field at the time of this invention so as to make the coupler carrier wear plate universal in character.

The distance between flange 14 and center portion 22 accommodates a substantially greater depth of coupler carrier. The distance between flange 14 and side portions 18, 20 corresponds to a coupler carrier having a lesser depth, nevertheless providing adequate strength to maintain the position of the coupler carrier wear plate, some load being transmitted through walls 24, 26 to portion 22. The primary load on the coupler carrier wear plate 10 is, however, in compression on web 12. The purpose of wear plate 10, as is well known, is to provide a sacrificial bearing surface so that the high strength and, accordingly, high cost forgings and castings can have maximum service life. The preferred ultra high molecular weight polymer, preferably a UHMW polyethylene has the added benefit of providing a tough material strong in compression which also has self-lubricating properties.

Figure 5:
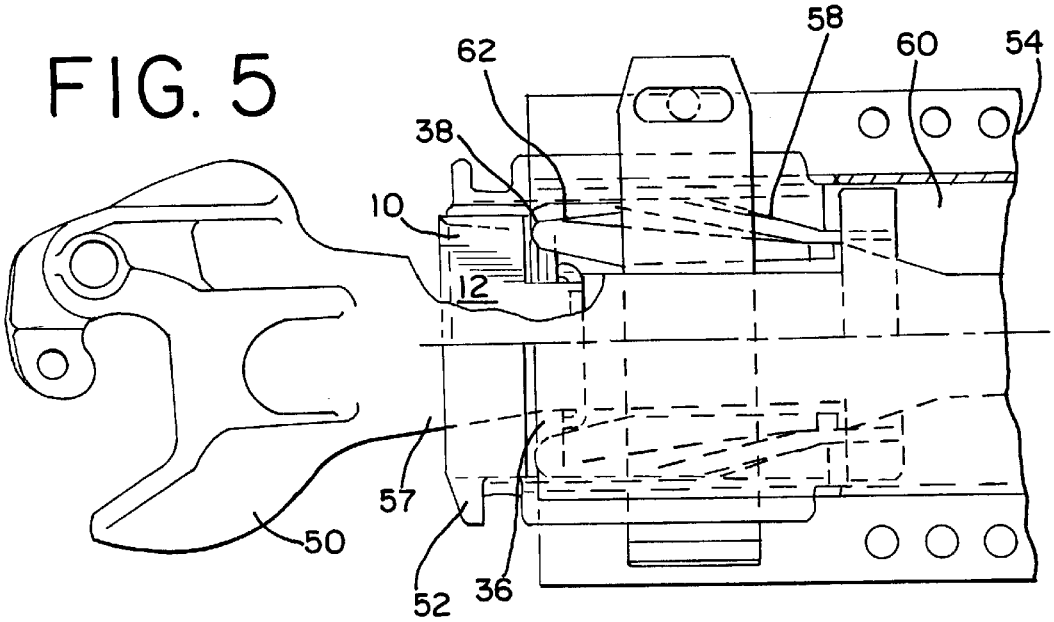
FIG. 5 is a top sectional view of railcar draft gear with the coupler carrier wear plate of the invention.
Figure 6:
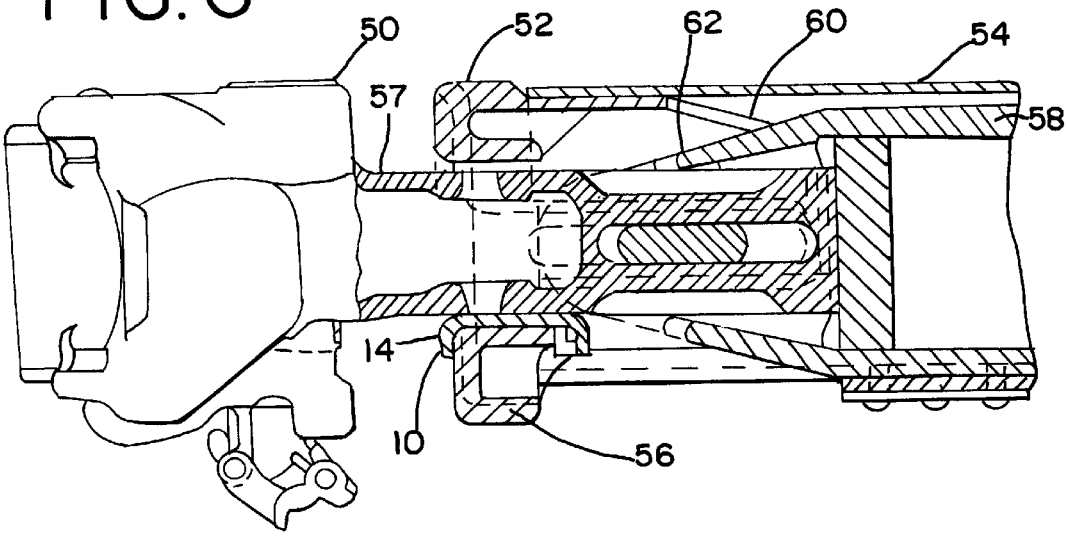
FIG. 6 is a left side sectional taken along the line 6—6 of FIG. 5 showing a view of railcar draft gear with the coupler carrier wear plate of the invention.

FIG. 5 and FIG. 6 show the installation of the coupler carrier wear plate 10 in a typical railroad car draft gear arrangement in which coupler 50 extends outward of striking casting 52. Striking casting 52 is affixed to railcar center sill assembly 54. Coupler carrier 56 supports shank 57 of coupler 50 through coupler carrier wear plate 10 which is captured therebetween.

Yoke 58 is fitted in draft gear pocket 60, pocket 60 being formed in railcar center sill assembly 54 in the conventional manner and in conformance with the regulations of the AAR, as will be known to one of ordinary skill in the art.

As part of the typical railcar draft gear arrangement, yoke 58 extends toward striking casting 52 terminating in yoke end 62, end 62 being formed with a taper shown in FIG. 6, the metal being formed to diverge outwardly as shown in FIG. 5. Due to variations in the specific patterns used by various manufacturers, and the need for clearance between coupler carrier wear plate 10 and end 62, bevel notch surfaces 36, 38 have been formed in coupler carrier wear plate 10. These provide adequate clearance for a variety of yoke ends 62 while also enabling coupler carrier wear plate 10 to be adapted to a variety of coupler carriers 56 of differing depth. This added clearance then enables the full extension of flange sides 18, 20 to the maximum allowable width, thereby maximizing utility of the coupler carrier wear plate in place of a straight channel shaped coupler carrier wear plate as is common in the prior art.

The drawings, specifically FIGS. 1 through 4 illustrate a number of features. It will be seen in FIG. 2 that bevel 36 depends downwardly from the surface of web 12 at an angle of about 15°. Bevel 36 extends generally in a direction from approximately along the line between opposing corners 70, 76 to the intersection of notched surfaces 32, 34 with the outer surface or face of flange 16.

It will also be noted that surfaces 28 and 30 are positioned inwardly of the inner surface of wall 24 and 26 respectively, the thereby structure defining apertures. In this configuration, of course, corner 76 between flat edge 78 and curved edge 80 mirror corner 70 and edges 72, 74. The aforementioned apertures 82, 84 are a function of the clearance provided by the surface configuration.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A universal coupler carrier wear plate comprising:

a supporting web having a generally T-shape configuration adapted to support said coupler and prevent wear to said coupler and adjacent elements of the coupler;

said web having outer and inner downwardly depending flanges attached thereto and spaced apart a sufficient distance to accommodate and protect said coupler carrier;

said inner flange being attached to the base portion of said T-shape, and being attached at its sides to said web by curved wall portions which in turn are attached to downwardly depending side portion flanges of substantially equal length to said inner flange and parallel to and spaced inwardly therefrom;

said side portion flanges being attached to said web adjacent its ends by downwardly sloped sections which also are attached to the base portion of said T-shaped web and which together with said curved wall sections create relieved areas;

said inner and side portion flanges, said sloped sections and said relieved areas being designed to accommodate coupler carriers of varying configurations.

2. The coupler carrier of claim 1 wherein said supporting web is self lubricating.

3. The coupler carrier of claim 2 wherein said supporting web is made of polyethylene.

4. The coupler carrier of claim 3 wherein said polyethylene is ultra high molecular weight.

5. Te coupler carrier of claim 3 wherein said polyethylene is cross linked.

6. The coupler carrier of claim 1 wherein the distance between said outer flange and said side portion flanges corresponds to a coupler having a lesser depth while the distance between said outer flange and said inner flange corresponds to a coupler carrier having a greater depth.

7. The coupler carrier of claim 6 wherein said lesser depth is approximately four (4") inches while said greater depth is approximately five (5") inches.

8. A coupler carrier wear plate comprising a web to support a railcar coupler;

flanges depending perpendicularly to said web to position and retain said coupler carrier wear plate on a coupler carrier;

said web having a first surface bearing said coupler and being formed in a generally T-shaped configuration having first and second opposed arms and a leg extending perpendicularly to said arms;

a beveled surface depending angularly downwardly from said first surface to provide additional clearance, said beveled surface merging into said flange.

9. The coupler carrier wear plate of claim 8 further comprising:

said flange including a central portion depending downwardly at the end of said leg and extending in a direction parallel to said arms;

said flanges further comprising an inner portion merging with said bevel surface and extending in a direction perpendicular to said central portion;

a wall having a surface parallel to said leg, said wall interconnecting said inner flange side portion to said inner flange central portion.

10. The coupler carrier wear plate of claim 9 further comprising said wall having both a straight surface and a curved portion.

* * * * *